US008047208B2

(12) United States Patent
Spiers et al.

(10) Patent No.: US 8,047,208 B2
(45) Date of Patent: Nov. 1, 2011

(54) DOUBLE ACTION FILTER ASSEMBLY WHEEL WITH FLIPPING WHEEL

(75) Inventors: Steven F. Spiers, Richmond, VA (US); G. Robert Scott, Midlothian, VA (US); Travis Garthaffner, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 1098 days.

(21) Appl. No.: 11/805,699

(22) Filed: May 24, 2007

(65) Prior Publication Data

US 2008/0006283 A1 Jan. 10, 2008

Related U.S. Application Data

(60) Provisional application No. 60/809,633, filed on May 31, 2006.

(51) Int. Cl.

| | |
|---|---|
| ***A24C 1/32*** | (2006.01) |
| ***B31C 99/00*** | (2009.01) |
| ***B65G 47/24*** | (2006.01) |
| ***B65G 47/256*** | (2006.01) |

(52) U.S. Cl. ..... 131/29; 131/282; 493/47; 198/411; 198/410; 198/402; 198/403; 198/373

(58) Field of Classification Search ..... 131/29, 131/57.5, 57, 94, 282; 493/39, 47; 198/402, 198/403, 373, 411, 410

See application file for complete search history.

(56) References Cited

U.S. PATENT DOCUMENTS

| | | | | |
|---|---|---|---|---|
| 4,577,644 | A * | 3/1986 | Grieben | 131/94 |
| 5,088,507 | A | 2/1992 | Baker et al. | |
| 6,098,782 | A | 8/2000 | Hardage et al. | |
| 2002/0119874 | A1 | 8/2002 | Heitmann et al. | |
| 2006/0112963 | A1 | 6/2006 | Scott et al. | |

FOREIGN PATENT DOCUMENTS

| | | | |
|---|---|---|---|
| WO | WO 2004/002246 | * | 1/2004 |
| WO | 2006048767 | | 5/2006 |

* cited by examiner

*Primary Examiner* — Richard Crispino
*Assistant Examiner* — Dionne W Mayes
(74) *Attorney, Agent, or Firm* — Connolly Bove Lodge & Hutz LLP

(57) ABSTRACT

The present invention relates to a method and apparatus for forming two filters in a two-up configuration. The apparatus includes a feed wheel 18, an assembly wheel 20, a take-off wheel 22, and a flipping wheel 24. According to the method of the invention, tubes 10 are loaded from the feed wheel 18 to the assembly wheel 20 where one hollow end of the tubes is filled. The half-filled tubes 10' are then transferred to take-off wheel 22 and then to a flipping wheel 24 where the tubes are flipped. The half-filled and flipped tubes 10" are returned to vacant positions on the feed wheel and transferred back to the assembly wheel so that the remaining hollow ends can be filled. The filled tube 10''' is transferred to a take-off wheel 22, where it is then removed from the take off wheel 22 using a stripper and/or additional wheels for further processing.

3 Claims, 3 Drawing Sheets

10
18
20
Ass'y
Wheel Has Rotated
144°
18E
10''
12
8
10'
26
4
5
3
1
20M
10
10'
2
10'
22
10''
6
24
7
10'

18
20
10''
20A
Ass'y
Wheel Has Rotated
18G'
10''
18E
6
3
2
4
1
22
24

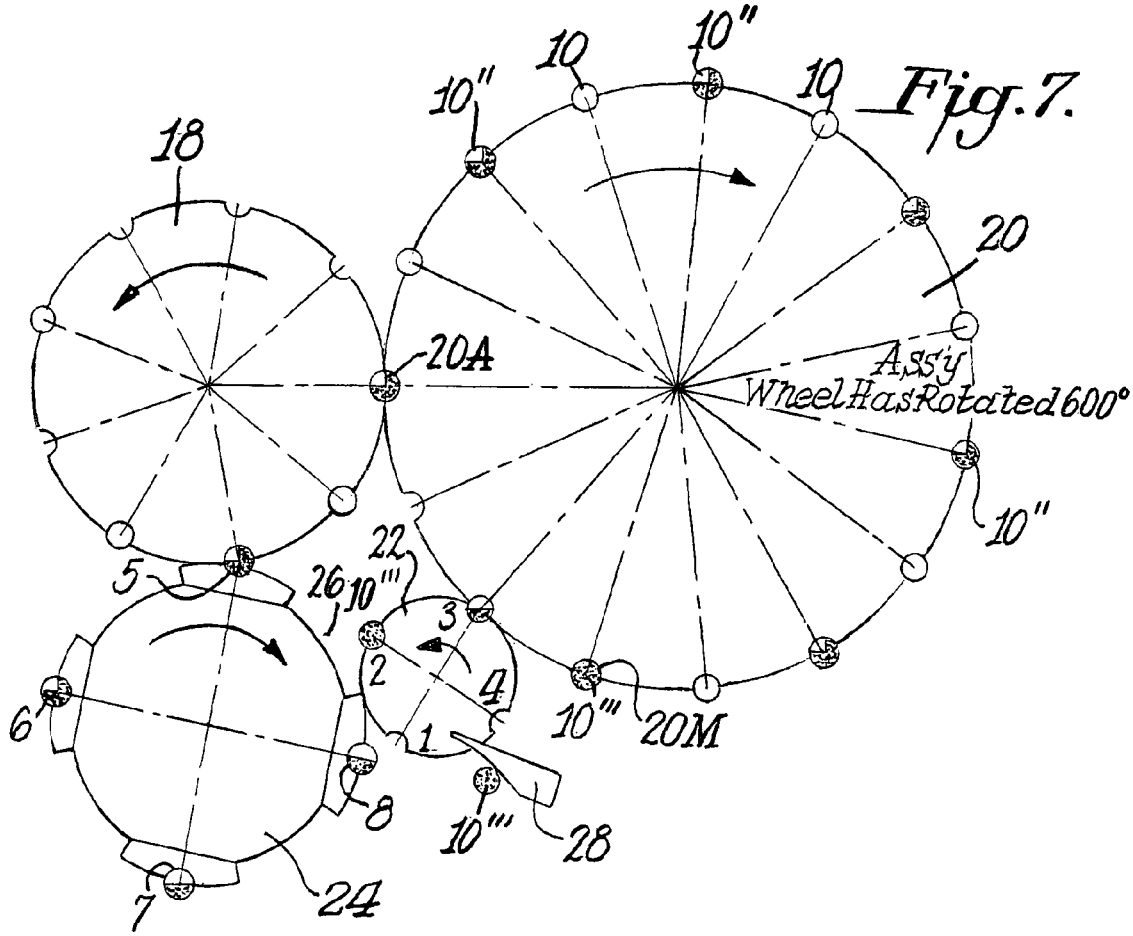
10- ⊙-- Rod Or Group With Both Ends Hollow
10'- ⊖-- Rod Or Group With The Exposed Hollow End Filled
10"- ⊖-- Rod Or Group Flipped To Exposed Opposite Hollow End
10'''- ⊖-- Finished Rod Or Group With Both Ends Filled

DOUBLE ACTION FILTER ASSEMBLY WHEEL WITH FLIPPING WHEEL

CROSS REFERENCE TO RELATED APPLICATION

The present application claims the benefit of provisional application Ser. No. 60/809,633, filed May 31, 2006, for all useful purposes, and the specification and drawings thereof are included herein by reference.

BACKGROUND OF THE INVENTION

Cigarette filter rods have been processed in pairs in the so-called "two-up" filter rod configuration. According to this configuration, one solid filter plug is in the middle of a tube so that an empty space is created on either end of the filter tube. Each end is filled with a sequence of granular material, such as carbon and the like, and solid material, such as cellulose acetate fibers or fibers with flavorant. Upon completion a tobacco rod may be joined to each end of the filter tube, and the central solid filter may then be cut in half to form two cigarettes.

A separate assembly wheel may be arranged to fill each side of the tube. One end of the tube is filled on one assembly wheel by vertically depositing and/or inserting filter materials into the upwardly facing opening. The product is then transferred through a drum system or similar device to flip the tube along its longitudinal axis. The flipped tube, which has the filled end facing downward and the open end facing upward, is then placed on a second assembly wheel so that filter materials could be inserted or deposited into the open end.

U.S. application Ser. No. 11/268,291, which is incorporated herein by reference, teaches a method of filling the open ends of the filter tube, including filling one end of the tube, inverting the tube and filling the other end. The application describes a method which utilizes a rotating tube flute plate, a rotating bin of granular material, a plurality of vertically orientated fill tubes and second fill tubes, a rotating filter segment plate and second filter segment plate, and a plurality of rotating plungers, all of which collectively comprise an upper wheel assembly rotating about a central vertical axis. A substantially identical lower wheel assembly also rotates about the same central vertical axis. A first end of each filter tube is filled with solid and/or granular material on the upper wheel assembly. A conveyor system removes half-filled filter tubes from the upper wheel assembly, inverts the tubes and places them on the rotating tube flute plate of the lower wheel assembly. The other ends of the filter tubes are then filled with solid and/or granular material on the lower wheel assembly. It would be advantageous, however, if both sides of the fill tube could be filled using only one wheel assembly.

It is therefore an objective of the present invention to develop a method that uses a single wheel assembly, as described herein below, to assemble components into both ends of a hollow tube having a solid center.

SUMMARY OF THE INVENTION

In accordance with the present invention a preformed tube of paper with hollow ends and a solid center of cellulose acetate or similar material is formed into two cigarette filters. Specifically, the process of producing compound cigarette filters according to the present invention comprises the steps of placing a filter tube with hollow ends and a solid filter center in a substantially vertical position. A tube is placed in every other flute of a feed wheel, which feeds the tubes to an assembly wheel. A predetermined amount of material is deposited into an upper open end of the filter tube directly against the solid center. The tube is then transferred to a flipping wheel where the tube is flipped about its vertical axis. The flipped tube is then returned to one of the vacant positions between unfilled tubes on the feed wheel where it is then transferred back to the assembly wheel. After both ends of the filter have been filled, the filled tube, or rod, is transferred to and unloaded from a take-off wheel. The solid central filter can be further processed by joining a tobacco rod to each end of the filter and cutting the filter in half to form two cigarettes, for example.

By using a single assembly wheel, the floor space required for this machine is considerably reduced. Also, since one wheel is used to fill both ends of the tube, a separate assembly wheel is not required for each end of the tube. This decreases setup time, machine cost, and machine complexity.

BRIEF DESCRIPTION OF THE DRAWINGS

Novel features and advantages of the present invention in addition to those noted above will become apparent to persons of ordinary skill in the art from a reading of the following detailed description in conjunction with the accompanying drawings wherein similar reference characters refer to similar parts and in which:

FIG. 7 is a schematic top plan view of an apparatus with processing wheels according to the present invention at a fourth stage of a process for forming cigarette filters and a legend for the symbols used in FIGS. 3-7.

DETAILED DESCRIPTION OF A PREFERRED EMBODIMENT

Figure 1:
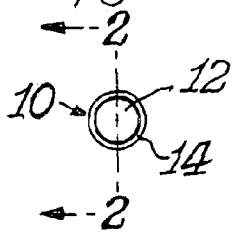
FIG. 1 is a top plan view of a fill tube of a 2-up filter.
Figure 2:
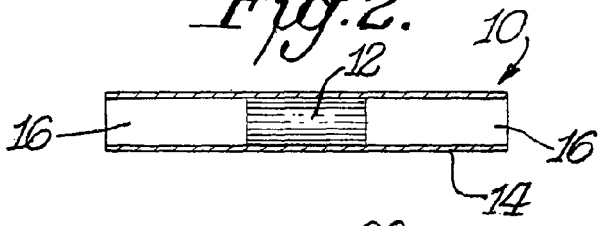
FIG. 2 is a cross-sectional view taken along line 2-2 of FIG. 1.

Referring with more particularity to the drawings, FIG. 1 illustrates a top view of a tube 10 that will be transported and filled according the present invention. Referring also to FIG. 2, tube 10 has a central filter 12 such as a plug of cellulose acetate tow or other suitable material. Filter 12 may wrapped with filter paper 14 so that two hollow openings 16 are formed at each end of the tube 10.

Figure 3:
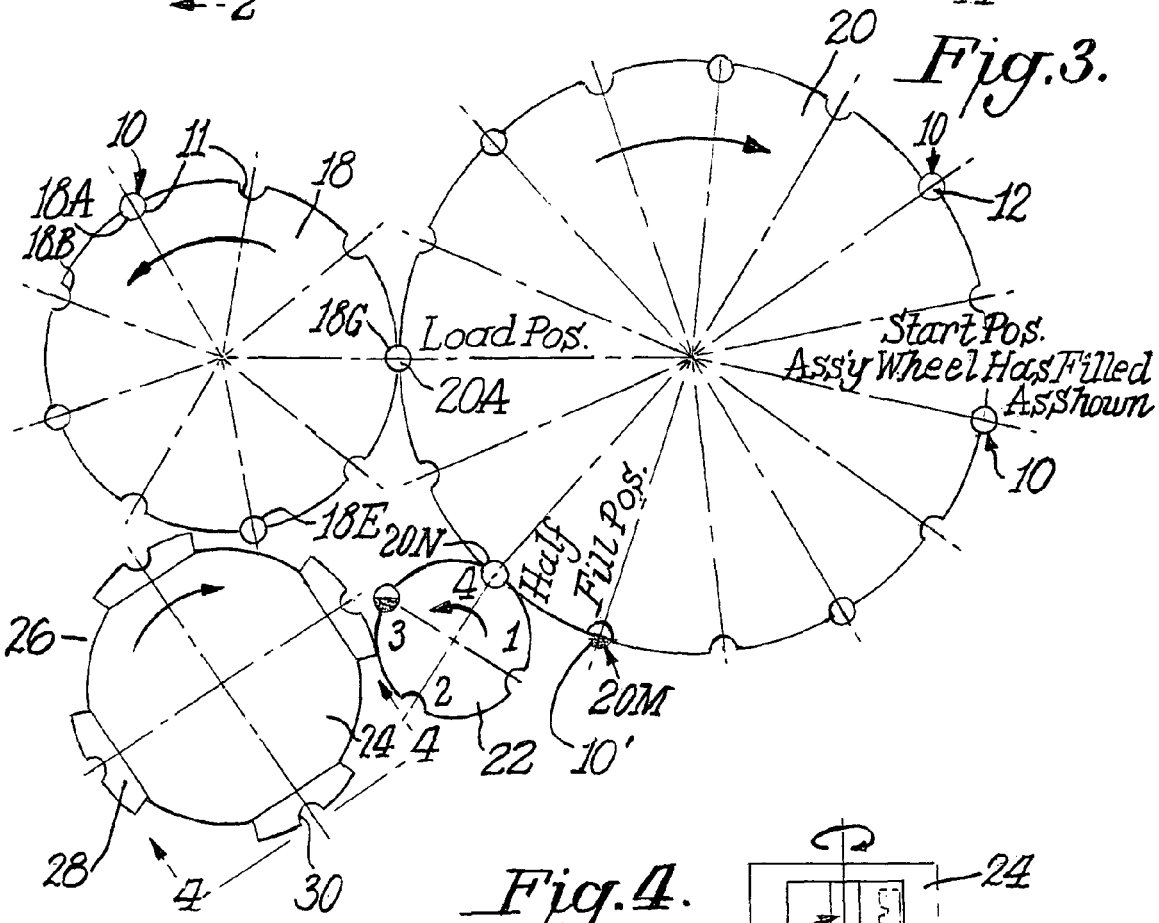
FIG. 3 is a schematic top plan view of an apparatus with processing wheels according to the present invention at a first stage of a process for forming cigarette filters.

FIG. 3 is a top plan view that schematically shows the apparatus for achieving the objectives of the present invention. The apparatus includes a feed wheel 18, an assembly wheel 20, a take-off wheel 22, and a flipping wheel 24. Generally speaking, a tube 10 will travel from the feed wheel 18, to the assembly wheel 20 where one hollow end will be filled. Half-filled tube 10' will then be transferred to take-off wheel 22 and then to a flipping wheel 24 where the tubes will be flipped so that the filled end will be facing in a down position and the remaining hollow end will be facing upward. The half-filled and flipped tubes 10" will be returned to a vacant position on the feed wheel and back to the assembly wheel so that the remaining hollow end can be filled. The filled tubes 10''' will then be placed on and removed from take-off wheel 22 for further processing and packaging. The specific manner in which hollow ends of filter tubes are filled is described in detail in U.S. application Ser. No. 11/268,291, which is incorporated herein by reference. The novel process of handling tubes 10 so that both ends can be filled using only one assembly wheel will now be described in greater detail.

Tubes 10 are first introduced to a feed wheel 18 at the flute 11 in position 18A in a conventional manner. The flutes 11 are the generally semi-circular tubular shaped openings along the perimeter of the wheel. For purposes of illustration, certain positions will be designated with letters representing a point during the process. As the wheel advances by spinning on its axis, flutes 11 will change from one process position to the next. Thus, each tube 10 will be loaded at position 18A. After it is loaded, the wheel will rotate and the tube 10 will move to processing position 18B, and so forth.

Tubes 10 are held within the flutes of the various wheels by vacuum or other suitable means. Tubes 10 are initially loaded in every other flute on the feed wheel 18 for reasons that will be made more apparent below. As the newly introduced tubes 10 travel in a counterclockwise direction along wheel 18, they are not affected by the flutes on the flipping wheel 24, which is traveling in a clockwise direction, because of a notch 26 between adjacent flutes on flipping wheel 24. This can be observed in FIG. 3, where tube 10 at position 18E passes by notch 26. Tubes 10 on feed wheel 18 travel to position 18G and are then transferred to the assembly wheel 20 at assembly wheel flute position 20A. At position 18G the vacuum holding tube 10 will be disengaged, while the vacuum at position 20A will be engaged, thus transferring tube 10 from wheel 18 to wheel 20. Adjacent flutes 11 on wheel 18 are aligned with adjacent flutes 11 on wheel 20, so that as the two wheels are turned tubes 10 are initially introduced at every other flute on assembly wheel 20.

As each tube 10 reaches position 20M on assembly wheel 20, the exposed hollow end has been filled according to conventional filling techniques to form a half-filled tube 10'. To discern between tubes at various stages of the process, it is useful at this point to introduce the designation system shown in FIG. 7. The designation system illustrated in FIG. 7 utilizes four symbols. The open circle designates a tube 10 in which no filter material has been introduced. Thus, both ends of tube 10 are hollow. The second symbol is a half-filled circle, which designates a tube 10' in which one of the exposed ends has been filled with filter materials and the filled end is facing in the upward direction. The third symbol is a three-quarter filled circle, which designates a tube 10' that has been flipped after one end has been filled so that the hollow end is facing relatively upward with respect to the filling device and the filled end is facing relatively downward. This configuration will be referred to as flipped tube 10". Finally, the fourth symbol is a completely filled circle, which designates a tube 10" in which both ends have been filled with filter materials to form tube 10'''.

Turning back to FIG. 3, a half-filled tube 10' is shown at position 20M. Thus, between point 20A and 20M one or more materials has been inserted or deposited in the upwardly facing end of tube 10. At position 20N, the half-filled tube 10' will lie between assembly wheel 20 and take-off wheel 22. The vacuum at position 20N will be disengaged, while a vacuum on the take-off wheel 22 will be engaged.

To describe the take-off wheel 22, it is useful to designate flutes 1-4, which will move from one processing position to the next. Thus, as shown in FIG. 3, when the half-filled tube 10' is located at position 20N, it will be aligned with flute 1 or 3 in wheel 22. The assembly wheel 20 and take-off wheel 22 are turned at speeds such that half-filled tubes 10' will be continuously transferred at position 20N to flutes 1 and 3, where they will then be transferred to flutes on flipping wheel 24.

Figure 4:
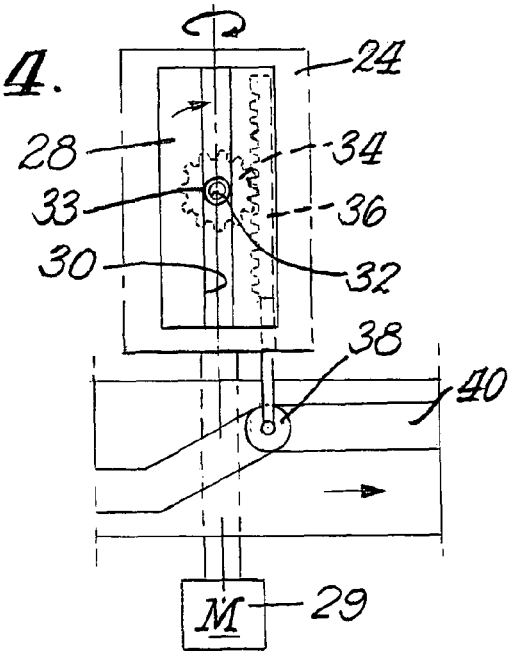
FIG. 4 is a front elevational view of one of the filter tube flippers according to the present invention and its 180° drive mechanism.

FIG. 4 shows a front elevational view of one of the filter tube flipping mechanisms 28 as viewed along line 4-4 in FIG. 3. Flipping wheel 24 has a motor 29 for rotating the wheel 24 and flipping mechanisms 28 for rotating to flip half-filled tubes 10' so that the empty end of filter tube 10' is facing upward. Flipping mechanisms 28 may have flutes 30 with a semicircular cross-section and suction ports 32 that retain half-filled filter tubes 10' by vacuum. The flipping mechanism 28 may also be attached to a shaft 33. A pinion 34 may be attached to the shaft 33 and engaged with a reciprocating rack 36. The reciprocating action of rack 36 may be caused by a wheel 38 at one end of the rack traveling along a cam track 40 as the flipping wheel 24 rotates under the power of motor 29. The rack, pinion, and cam track may be designed so that the filter tube 10' is flipped 1800 after it is transferred from take-off wheel 22 to flipping wheel 24 and before the flipped filter tube 10" is transferred to feed wheel 18.

Figure 5:
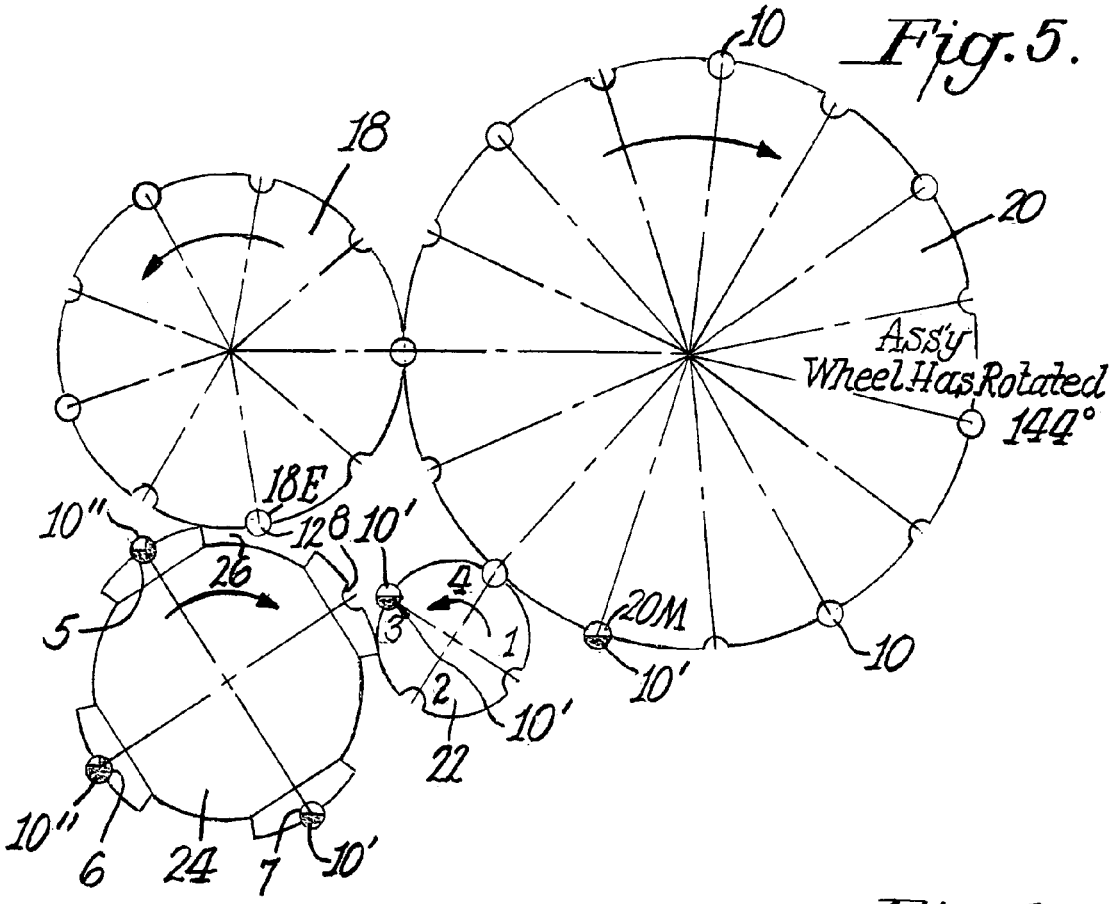
FIG. 5 is a schematic top plan view of an apparatus with processing wheels according to the present invention at a second stage of a process for forming cigarette filters.

FIG. 5 shows the positions of the wheels and the tubes after assembly wheel 20 has rotated 144 degrees from the position shown in FIG. 3. Half-filled tubes 10' are in positions 20M of assembly wheel 20 and flute 7 of flipping wheel 24. Flipped tubes 10" with their hollow ends exposed are in flutes 5 and 6. The flipped half-filled tubes 10" are then transferred to the next empty flute on the feed wheel 18. Note that due to the timing of the wheels, the flipped tube 10" will be placed in one of the flutes previously empty because hollow tubes 10 are initially loaded only in every other flute if wheel 18. As noted earlier, the hollow tube 10 at position 18E passes through notch 26, as shown in FIG. 5.

Figure 6:
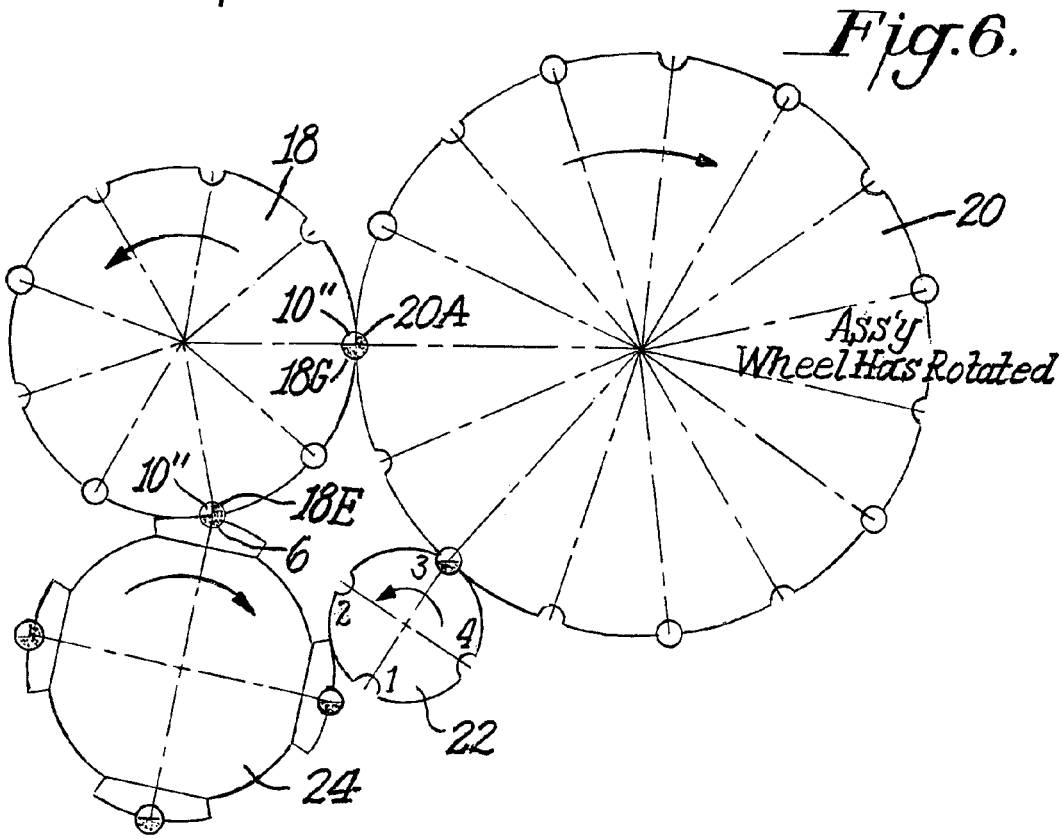
FIG. 6 is a schematic top plan view of an apparatus with processing wheels according to the present invention at a third stage of a process for forming cigarette filters.

FIG. 6 shows the positions of the wheels and tubes after assembly wheel 20 has rotated 216 degrees from the position shown in FIG. 3. As the wheels continue to turn, flipped half-filled tube 10" that was in flute 5 of wheel 24 in FIG. 5 is now at point 18G. A vacuum at position 18G will be disengaged, while the vacuum at position 20A will be engaged. Tube 10" in flute 6 is loaded onto feed wheel 18 at position 18E. A vacuum at position 6 will be disengaged, while the vacuum at position 18E will be engaged.

FIG. 7 shows the positions of the wheels and tubes after the assembly wheel has rotated 600 degrees from the position shown in FIG. 3. The previously half-filled, flipped tubes 10" are completely filled as they are rotated about wheel 20 to form finished filled tubes 10''' as seen at position 20M. The completely filled tubes 10''' are transferred to flutes 2 and 4 on the take-off wheel 22, while the half-filled tubes 10' continue to transfer to flutes 1 and 3 en route to flipping wheel 24, as described previously. As the completely filled tubes 10''' pass the flipping wheel 24 they pass by notches 26 to thereby miss the flipping flutes 5-8 and a vacuum from the upper manifold continues to hold them on take-off drum 22 until they reach the stripper 28. When they reach stripper 28, the vacuum may be turned off and the finished product may be removed from the machine for further processing and packaging. Of course, an additional wheel could be used to remove the finished product instead of stripper 28.

With both ends of the filter tube 10''' filled with granular material and solid filter segments, a two-up dual filter has been formed, which when combined with wrapped tobacco rods at each end thereof ultimately produces two complete cigarettes (not shown). The dual filter can be cut through the middle of the central solid filter to separate the two cigarettes.

After separation, the cigarette filter may have a length of approximately 30 mm, but can be shorter or longer, if desired.

It should be understood that the above detailed description while indicating preferred embodiments of the invention are given by way of illustration only since various changes and modifications within the spirit and scope of the invention will become apparent to those skilled in the art from the detailed description.

For example, it should be noted that the number of flutes illustrated on each wheel is limited for simplicity. Obviously, many more flutes could be evenly spaced along the entire outer diameter of the particular wheel to increase the number of tubes that could be processed for each full turn of the wheel. Each flute shown in FIGS. 3-7 could represent a group of flutes. In short, the number of tubes and flutes shown on each wheel could be changed and still produce the same result.

What is claimed is:

1. An apparatus for filling ends of an opened ended tube comprising:

a feed wheel;

an assembly wheel;

a take-off wheel; and a flipping wheel;

wherein the feed wheel comprises a plurality of flutes for accepting and retaining open ended tubes, the open ended tubes comprising a substantially solid central portion in the middle of the tube and tubular shaped hollow openings on opposite ends of the central portion, the open ended tubes initially loaded only in every other flute; and wherein the assembly wheel comprises a plurality of flutes for accepting open ended tubes from the feed wheel, the open ended tubes being fed from every other flute of the feed wheel to every other flute of the assembly wheel, the upwardly facing hollow opening in the open ended tube being filled with granular material while on the assembly wheel to form a half-filled tube; and wherein the flipping wheel comprises a plurality of flutes for accepting half-filled tubes from the take-off wheel, the flutes being able to rotate so that the filter tubes can be flipped and the remaining hollow opening of the tube positioned to face generally upward, the flipping wheel configured to transfer flipped tubes into the positions left vacant during the initial loading of the feed wheel so that open ended tubes and half-filled tubes can be loaded in alternating order into every position on the assembly wheel for filling the upwardly facing open ends.

2. The apparatus of claim 1, wherein the take-off wheel is configured to transfer half-filled tubes to the flipping wheel and fully filled tubes to a stripper.

3. An apparatus comprising:

a feed wheel with a plurality of flutes for accepting filter tubes, the filter tubes comprising a central filter and a wrapper, the wrapper extending beyond the central filter to form hollow openings or either end of the central filter, the filter tubes initially placed only in every other flute;

an assembly wheel with a plurality of flutes for accepting filter tubes from the feed wheel, the filter tubes being from every other flute of the feed wheel to every other flute of the assembly wheel, the upwardly facing hollow opening in the filter tube being filled with granular material while on the assembly wheel to form a half-filled tube;

a take-off wheel with a plurality of flutes for accepting filter tubes from the assembly wheel, and a flipping wheel with a plurality of flutes for accepting filter tubes from the take-off wheel, the flutes being able to rotate, so that the filter tubes can be flipped and the remaining hollow opening of the filter tube positioned to face generally upward, the flipping wheel configured to transfer flipped filter tubes into the vacant positions on the feed wheel so that the remaining hollow opening can be filled with granular material on the assembly wheel, wherein the take-off wheel is configured to transfer half-filled tubes to the flipping wheel and fully filled tubes to a stripper.

* * * * *